US011259610B2

(12) United States Patent
Clervi

(10) Patent No.: US 11,259,610 B2
(45) Date of Patent: Mar. 1, 2022

(54) FOLDABLE BAG

(71) Applicant: NIKE, Inc., Beaverton, OR (US)

(72) Inventor: Vincent Clervi, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 617 days.

(21) Appl. No.: 16/104,461

(22) Filed: Aug. 17, 2018

(65) Prior Publication Data

US 2019/0053589 A1 Feb. 21, 2019

Related U.S. Application Data

(60) Provisional application No. 62/547,142, filed on Aug. 18, 2017.

(51) Int. Cl.

| | |
|---|---|
| ***A45C 7/00*** | (2006.01) |
| ***A45C 13/03*** | (2006.01) |
| ***A45C 3/12*** | (2006.01) |
| ***A45C 3/00*** | (2006.01) |

(52) U.S. Cl.

CPC ..... *A45C 7/0095* (2013.01); *A45C 3/004* (2013.01); *A45C 3/12* (2013.01); *A45C 13/03* (2013.01)

(58) Field of Classification Search

CPC ..... A45C 7/0095; A45C 3/004; A45C 3/12; A45C 13/03

See application file for complete search history.

(56) References Cited

U.S. PATENT DOCUMENTS

| | | | | |
|---|---|---|---|---|
| 1,121,366 | A * | 12/1914 | Hurrell | B62J 9/00 224/429 |
| 1,606,538 | A * | 11/1926 | Simeonoff | D05B 91/14 223/107 |
| D116,159 | S | 8/1939 | Brody | |
| 2,574,730 | A * | 11/1951 | Crew | F41C 33/06 206/317 |
| 2,672,263 | A | 3/1954 | Alber | |
| 3,108,627 | A | 10/1963 | Tatelman | |
| 3,125,145 | A | 3/1964 | Williams | |
| 3,837,546 | A | 9/1974 | Westermann | |
| D234,688 | S | 4/1975 | Westermann | |
| D276,907 | S | 12/1984 | Cunningham | |
| D309,677 | S | 8/1990 | Yelder et al. | |
| D315,640 | S | 3/1991 | Pelzel | |
| D350,435 | S | 9/1994 | Smith, IV | |
| D354,851 | S | 1/1995 | Smith et al. | |
| 5,488,799 | A * | 2/1996 | Hauschild | A45F 3/00 43/26 |

(Continued)

*Primary Examiner* — Tri M Mai

(74) *Attorney, Agent, or Firm* — Honigman LLP; Matthew H. Szalach; Jonathan O'Brien

(57) ABSTRACT

A foldable bag includes a main body having a central longitudinal axis, a first outer edge having a first longitudinal axis that is convergent with the central longitudinal axis, and a second outer edge disposed on an opposite side of the central longitudinal axis than the first outer edge and having a second longitudinal axis that is convergent with the central longitudinal axis. The main body is operable between an open state having the first outer edge separated from the second outer edge and a first closed state having the first outer edge aligned with and attached to the second outer edge. A first storage compartment is attached to a first side of the main body.

19 Claims, 5 Drawing Sheets

(56) References Cited

U.S. PATENT DOCUMENTS

| | | | | |
|---|---|---|---|---|
| 6,176,356 | B1 * | 1/2001 | Powley | A45C 7/0095 190/1 |
| D459,877 | S | 7/2002 | Laprise | |
| 6,789,713 | B1 * | 9/2004 | Redzisz | A01K 97/08 206/315.11 |
| 6,966,439 | B2 * | 11/2005 | Weleczki | A45C 7/0077 206/315.3 |
| 7,210,177 | B1 * | 5/2007 | John | A45C 3/10 383/4 |
| D578,763 | S | 10/2008 | Walker | |
| 7,785,008 | B2 * | 8/2010 | Schoenig | B65F 1/0006 383/4 |
| 8,181,775 | B2 | 5/2012 | Bunn | |
| D689,282 | S | 9/2013 | Lindeman | |
| D744,234 | S * | 12/2015 | Quinnan | D3/262 |
| D784,020 | S | 4/2017 | Kutting | |
| D852,501 | S * | 7/2019 | Dolfi | D3/262 |
| 2009/0220177 | A1 | 9/2009 | Andreu | |
| 2012/0272561 | A1 * | 11/2012 | Risley | F41C 33/06 42/96 |

* cited by examiner

FOLDABLE BAG

CROSS REFERENCE TO RELATED APPLICATION

This application claims priority under 35 U.S.C. § 119(e) to Provisional U.S. Patent Application No. 62/547,142, filed Aug. 18, 2017, the disclosure of which is hereby incorporated by reference in its entirety.

FIELD

The present disclosure relates generally to foldable bag, and more particularly to a foldable bag for apparel and footwear.

BACKGROUND

This section provides background information related to the present disclosure and is not necessarily prior art.

Bags for merchandise or apparel conventionally include a single cavity accessible through an opening in the bag. Although suitable for storage and transportation of several articles of merchandise or apparel, conventional bags are not without drawbacks. For instance, with traditional bags and gym sacks, all articles of merchandise and apparel are placed within the single cavity for transportation and storage.

Placing all articles of merchandise or apparel within the same cavity may result in disorganization of the articles. For example, in a bag having a single cavity, footwear and clothing may all be kept in the cavity simultaneously. As the goods are transported, apparel within the cavity may become wrinkled, or may tangle or interfere with the footwear. Likewise, when one wishes to retrieve items from the cavity, it may be necessary to sort through the cavity or to empty the cavity entirely in order to find the desired item. Additionally, traditional bags fail to provide visibility of articles within the cavity. Instead, an inventory of the cavity must be maintained, or a user must periodically sort through the cavity to determine its contents.

Thus, while known bags have proven acceptable for their intended purpose, a continuous need for improvement in the relevant art remains. For instance, a need exists for a bag that provides more than one storage cavity in order to provide improved organization. A need also exists for a bag that provides easy access to and visibility of the contents of the bag during storage, while also remaining compact for easy transportation.

DRAWINGS

The drawings described herein are for illustrative purposes only of selected configurations and not all possible implementations, and are not intended to limit the scope of the present disclosure FIG. 1 is a front view of a bag in accordance with principles of the present disclosure;

Corresponding reference numerals indicate corresponding parts throughout the drawings.

DETAILED DESCRIPTION

Figure 1:
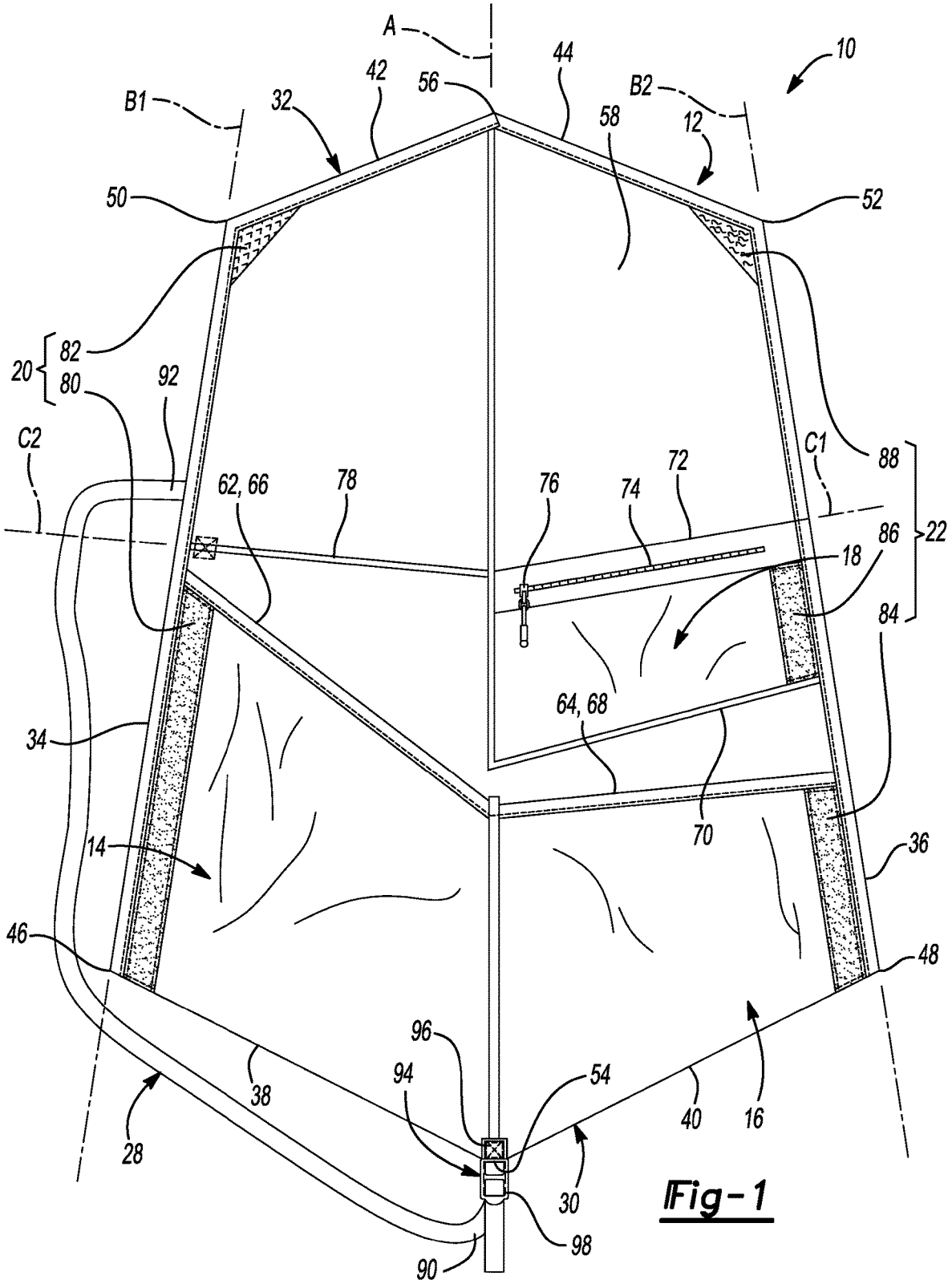

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a foldable bag. The bag includes a main body including a central longitudinal axis, a first outer edge having a first longitudinal axis that is convergent with the central longitudinal axis, and a second outer edge disposed on an opposite side of the central longitudinal axis than the first outer edge and having a second longitudinal axis that is convergent with the central longitudinal axis. The main body is operable between an open state having the first outer edge separated from the second outer edge and a first closed state having the first outer edge aligned with and attached to the second outer edge. A first storage compartment is attached to a first side of the main body.

In some implementations, the main body of the bag is symmetric about the central longitudinal axis.

In some examples, the first longitudinal axis is convergent with the second longitudinal axis when the main body is in the open state. Further, the first longitudinal axis may be parallel to the second longitudinal axis when the main body is in the first closed state.

In yet another example, the first longitudinal axis is parallel to the second longitudinal axis when the main body is in the first closed state.

In another example, the bag may further include a second storage compartment attached to the first side of the main body. The first storage compartment may be spaced apart from the second storage compartment when the main body is in the open state. Further, the first storage compartment may oppose and be in contact with the second storage compartment when the main body is in the first closed state.

In another configuration, the bag may include a first fastener associated with the first outer edge and a second fastener associated with the second outer edge. The first fastener is operable to be attached to the second fastener when the main body is in the first closed state.

In yet another configuration, the main body may be operable to be folded into a second closed state when in the first closed state. The main body may include a second side disposed on an opposite side of the main body than the first side. A first portion of the second side may be in contact with a second portion of the second side when the main body is folded into the second closed state. The bag may further comprise a first fastener attached to the first portion and a second fastener attached to the second portion. The first fastener may be selectively attached to the second fastener to maintain the main body in the second closed state. Alternatively, the main body may be folded about an axis extending transverse to the first longitudinal axis when the main body is moved from the first closed state to the second closed state.

In another aspect of the disclosure, a bag is provided and includes a main body including a central longitudinal axis, a first side, and a second side disposed on an opposite side of the main body than the first side. The main body is operable between an open state, a first closed state having a first portion of the first side in contact with a second portion of the first side, and a second closed state. The main body is folded about a lateral axis crossing the central longitudinal axis when moved from the first closed state to the second closed state, to bring a first portion of the second side in contact with a second portion of the second side. A first storage compartment is attached to the first side of the main body.

Implementations of this aspect of the disclosure may include one or more of the following optional features.

In some implementations, the main body may be symmetric about the central longitudinal axis.

In some examples, the first outer edge includes a first longitudinal axis that is convergent with a second longitudinal axis of the second outer edge when the main body is in the open state. The first longitudinal axis may be parallel to the second longitudinal axis when the main body is in the first closed state.

In another example, the first outer edge may include a first longitudinal axis that is parallel to a second longitudinal axis of the second outer edge when the main body is in the first closed state.

In some implementations, the bag may include a second storage compartment attached to the first side of the main body. The first storage compartment may be spaced apart from the second storage compartment when the main body is in the open state. Further, the first storage compartment may oppose and be in contact with the second storage compartment when the main body is in the first closed state.

In yet another configuration, a first fastener may be associated with the first outer edge and a second fastener may be associated with the second outer edge. The first fastener is operable to be attached to the second fastener when the main body is in the first closed state.

In other configurations, the main body includes a second side disposed on an opposite side of the main body than the first side. A first portion of the second side may be in contact with a second portion of the second side when the main body is moved into the second closed state. The bag may further comprise a first fastener attached to the first portion and a second fastener attached to the second portion, such that the first fastener may be selectively attached to the second fastener to maintain the main body in the second closed state.

In another example, the lateral axis is substantially perpendicular to the first edge. The lateral axis may also be substantially perpendicular to the second edge.

In a further configuration, the lateral axis may be substantially perpendicular to the second edge.

The details of one or more implementations of the disclosure are set forth in the accompanying drawings and the description below. Other aspects, features, and advantages will be apparent from the description, the drawings, and the claims.

Figure 2:
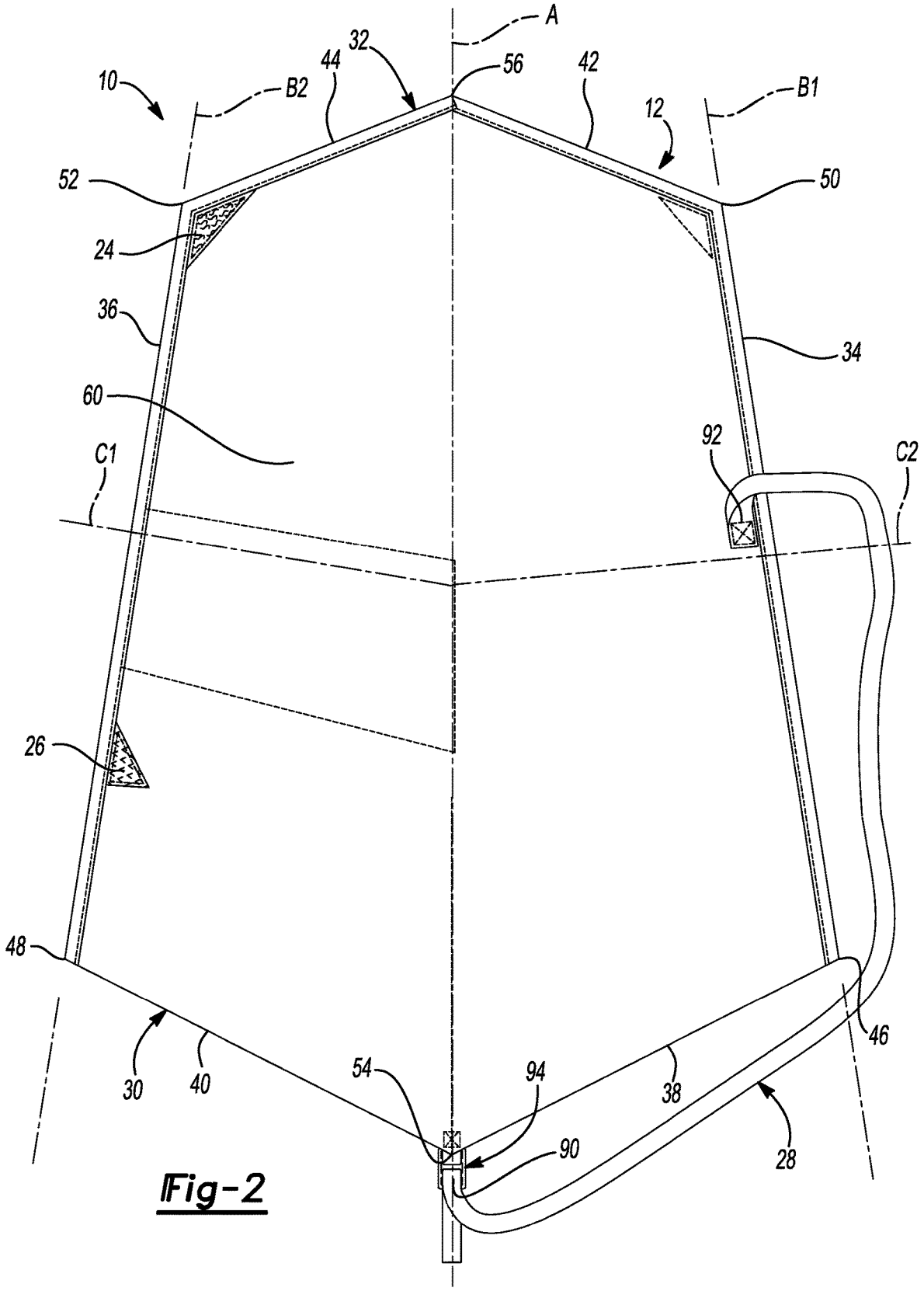
FIG. 2 is a back view of the bag of FIG. 1.
Figure 3:
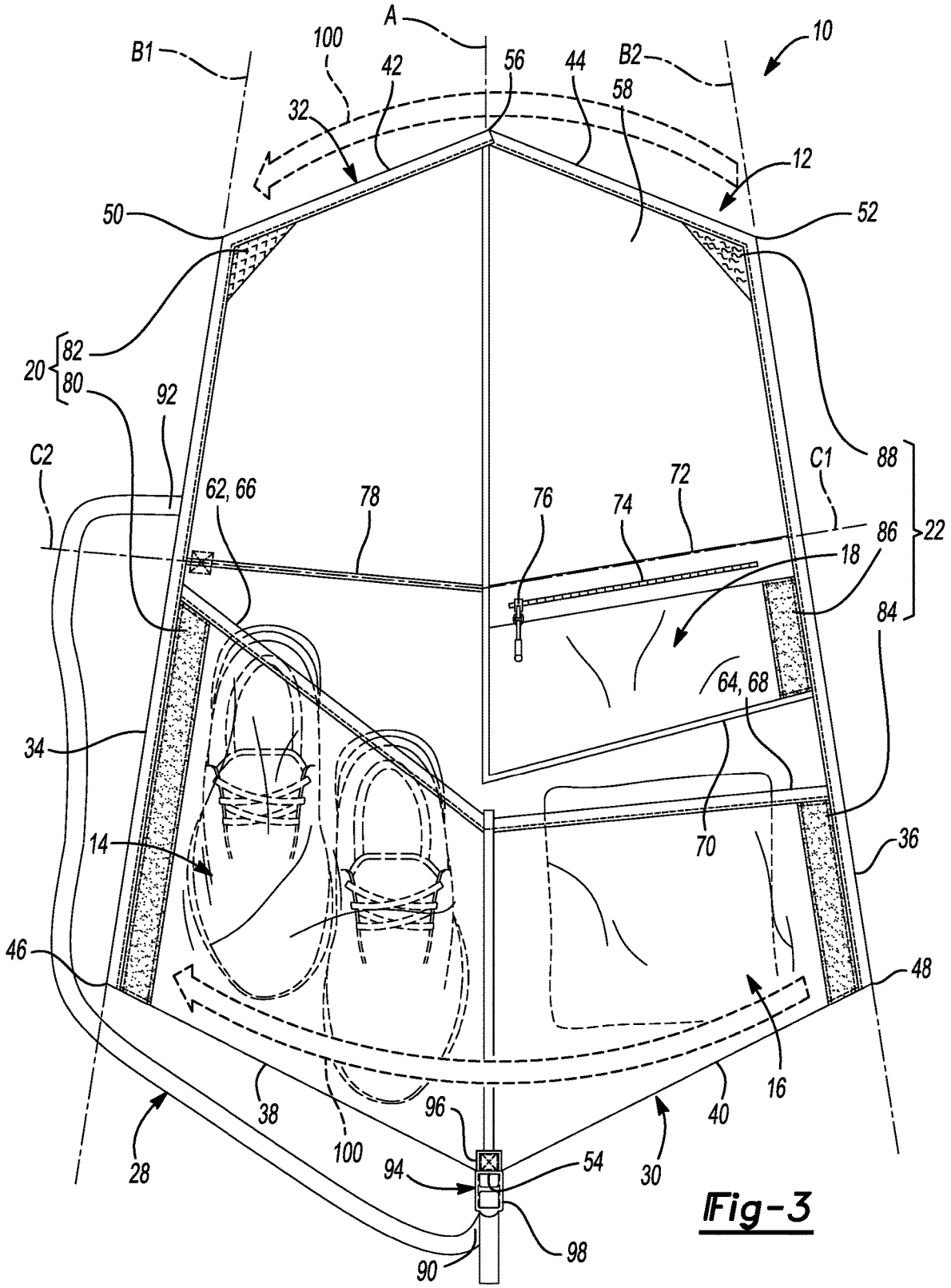
FIG. 3 is a front view of the bag of FIG. 1, including articles of footwear in a first storage compartment and apparel in a second storage compartment.

Referring to FIGS. 1-5, a foldable bag 10 is provided and includes a main body 12. As illustrated in FIGS. 1 and 3, the main body 12 may include a first storage compartment 14, a second storage compartment 16, and a third storage compartment 18. The first storage compartment 14, the second storage compartment 16, and the third storage compartment 18 may all be attached to the main body 12. The bag 10 may also include a plurality of fasteners 20, 22, 24, 26 and a strap 28. As will be explained in more detail below, the fasteners 20, 22, 24, 26 may be used to secure the bag 10 in a first closed state and in a second closed state. The strap 28 extends from the main body 12 for carrying the bag 10 when the bag 10 is in the second closed state.

With reference to FIGS. 1-3, the bag 10 is illustrated in an unfolded or open state. It will be appreciated that the described features of the bag 10 may be arranged differently with respect to each other when the bag 10 is in the first closed state (e.g., FIG. 4), the second closed state (e.g., FIG. 5), or other closed states, as discussed further below.

As shown in FIGS. 1-3, the main body 12 of the bag 10 includes a first end 30 and an opposing second end 32 connected to each other by a first outer edge 34 and an opposing second outer edge 36. In the illustrated configuration, the main body 12 is symmetrically formed about a central axis A. For example, the first outer edge 34 and the second outer edge 36 may be symmetrically disposed on opposite sides of the central axis A. More specifically, the central axis A may be a central longitudinal axis A running along a length of the main body 12 from the first end 30 to the second end 32. The length of the main body 12 may be greater than a width extending from the first outer edge 34 to the second outer edge 36. In alternate configurations, the width of the bag 10 may be greater than the length.

The first outer edge 34 and the second outer edge 36 may define a first longitudinal axis B1 and a second longitudinal axis B2, respectively. The first longitudinal axis B1 may be symmetric to the second longitudinal axis B2 relative to the central longitudinal axis A. Further, the first longitudinal axis B1 and the second longitudinal axis B2 may be convergent with the central longitudinal axis A and with each other in a direction extending from the first end 30 to the second end 32, such that all of the axes A, B1, B2 intersect at a common theoretical apex (not shown) spaced from the second end 32 of the bag 10. In other words, the first outer edge 34 and the second outer edge 36 may be tapered inwardly with respect to the central longitudinal axis A, such that the width between the first outer edge 34 and the second outer edge 36 is greater at the first end 30 of the bag 10 than at the second end 32 of the bag 10. It will be appreciated, however, that the first longitudinal axis B1 of the first outer edge 34 and the second longitudinal axis B2 of the second outer edge 36 may be parallel to each other and to the central longitudinal axis A, within the scope of the present disclosure, such that the width of the main body 12 is constant along the length of the bag 10.

In some configurations of the bag 10, the main body 12 may be polygonal, having a plurality of straight outer edges. In a configuration shown in FIGS. 1-5, the main body 12 is formed as a hexagon having six (6) straight edges, such that each of the first end 30 of the main body 12 and the second end 32 of the main body 12 each includes a pair of edges spanning the width between the first outer edge 34 and the second outer edge 36. Specifically, the first end 30 of the main body 12 may include a third outer edge 38 and a fourth outer edge 40, and the second end 32 of the main body 12 may include a fifth outer edge 42 and a sixth outer edge 44. The third outer edge 38 and the fourth outer edge 40 may be symmetrically disposed on opposite sides of the central axis A, and the fifth outer edge 42 and the sixth outer edge 44 may be symmetrically disposed on opposite sides of the central axis A.

The third outer edge 38 may intersect the first outer edge 34 to form a first corner 46 at the first end 30 of the main body 12, while the fourth outer edge 40 may intersect the second outer edge 36 to form a second corner 48 at the first end 30 of the main body 12. The first corner 46 and the second corner 48 may be symmetrically disposed on opposite sides of the central axis A. Likewise, the fifth outer edge 42 may intersect the first outer edge 34 to form a third corner 50 at the second end 32 of the main body 12, while the sixth outer edge 44 may intersect the second outer edge 36 to form a fourth corner 52 at the second end 32 of the main body 12. The third corner 50 and the fourth corner 52 may be symmetrically disposed on opposite sides of the central axis A. The third outer edge 38 may intersect the fourth outer edge 40 at the central longitudinal axis A to form a fifth corner 54 at the first end 30, and the fifth outer edge 42 may intersect the sixth outer edge 44 at the central longitudinal axis A to form a sixth corner 56 at the second end 32. Accordingly the central longitudinal axis A may extend between, and be defined by, the fifth corner 54 and the sixth corner 56.

The main body 12 of the bag 10 may be formed of a flexible material, such that the main body 12 is foldable upon itself. Suitable materials for the main body 12 are selected to impart desired properties of strength and durability, weight, water resistance, resilience, and flexibility. For example, the material of the panel may include synthetic fabrics, such as nylon, polyester, rayon, spandex, or the like. Alternatively, the material of the main body 12 may be a natural fabric.

In some implementations, the main body 12 is formed of a single panel of the flexible material. However, the main body 12 may be formed as a laminate, including a plurality of panels joined together with each other. A material of each the panels may be selected to provide one or more of the desired properties of the main body 12. For example, a first panel may be formed of material for providing a desired water resistance, while a second panel may be formed of a material for providing a desired strength and durability.

The first storage compartment 14 may be attached to the front side 58 of the main body 12 and may be disposed between the central longitudinal axis A and the first outer edge 34. With reference to FIG. 1, the first storage compartment 14 may be joined to the main body 12 along the third outer edge 38 and may span a distance between the central longitudinal axis A and the first outer edge 34. In some implementations, the first storage compartment 14 is joined to the main body 12 along an entirety of the third outer edge 38 such that the first storage compartment 14 spans a distance from the central longitudinal axis A to the first outer edge 34. The first storage compartment 14 may be joined to, and extend partially along, each of the first outer edge 34 and the central longitudinal axis A, such that an upper edge 62 of the first storage compartment 14 is formed between the first end 30 and the second end 32 of the main body 12. The upper edge 62 of the first storage compartment 14 may be arranged at an oblique angle with respect to each of the first outer edge 34, the central longitudinal axis A, and the third outer edge 38. More specifically, the upper edge 62 of the first storage compartment 14 may diverge from the third outer edge 38 along a direction extending from the central longitudinal axis A to the first outer edge 34.

The second storage compartment 16 may be attached to the front side 58 of the panel and may be formed between the central longitudinal axis A and the second outer edge 36. With reference to FIG. 1, the second storage compartment 16 may be joined to the main body 12 along the fourth outer edge 40 and may span a distance between the central longitudinal axis A and the second outer edge 36. In some implementations, the second storage compartment 16 is joined to the main body 12 along an entirety of the fourth outer edge 40 such that the second storage compartment 16 spans a distance from the central longitudinal axis A to the second outer edge 36. The second storage compartment 16 may be joined to, and extend partially along, each of the second outer edge 36 and the central longitudinal axis A, such that an upper edge 64 of the second storage compartment 16 is formed between the first end 30 and the second end 32 of the main body 12. In some implementations, the upper edge 64 of the second storage compartment 16 is arranged at an oblique angle with respect to each of the first outer edge 34 and the fourth outer edge 40, and is substantially perpendicular to the central longitudinal axis A. More specifically, the upper edge 64 of the second storage compartment 16 may converge with the fourth outer edge 40 along a direction extending from the central longitudinal axis A to the first outer edge 34. It will be appreciated, however, that the upper edge 64 may be arranged at an oblique angle with respect to the central longitudinal axis A within the scope of the present disclosure.

Referring again to FIGS. 1 and 3, an opening 66 of the first storage compartment 14 is provided between the upper edge 62 and the main body 12, and an opening 68 of the second storage compartment 16 is provided between the upper edge 64 and the main body 12. As shown in FIGS. 1 and 3, the openings 66, 68 of the first storage compartment 14 and the second storage compartment 16 may not include any closures, such that each of the storage compartments 14, 16 is continuously accessible. However, the openings 66, 68 of one or both of the first storage compartment 14 and the second storage compartment 16 may be provided with a closure, such that the storage compartments 14, 16 are selectively accessible, as discussed below with respect to the third storage compartment 18.

The third storage compartment 18 may be attached to the front side 58 of the panel and may be formed between the central longitudinal axis A and the second outer edge 36. With reference to FIGS. 1 and 3, the third storage compartment 18 may be disposed intermediate the second storage compartment 16 and the second end 32 of the main body 12, and may span a distance between the central longitudinal axis A and the second outer edge 36. In some implementations, the third storage compartment 18 spans a distance from the central longitudinal axis A to the second outer edge 36. The third storage compartment 18 may be joined to and extend partially along each of the second outer edge 36 and the central longitudinal axis A. A bottom edge 70 of the third storage compartment 18 may be joined to the front side 58 of the main body 12 adjacent the upper edge 64 of the second storage compartment 16. In some implementations, the bottom edge 70 of the third storage compartment 18 is formed at an oblique angle with respect to each of the central longitudinal axis A and the second outer edge 36, such that the bottom edge 70 of the third storage compartment 18 diverges from the upper edge 64 of the second storage compartment 16 and converges with the fourth outer edge 40 of the main body 12, along the direction from the central longitudinal axis A to the second outer edge 36. It will be appreciated, however, that the bottom edge 70 may be arranged substantially perpendicular to one of the central longitudinal axis A or the second outer edge 36 within the scope of the present disclosure. In this regard, in some implementations, the bottom edge 70 of the third storage compartment 18 is substantially parallel to the fourth outer edge 40 of the main body 12. An upper edge 72 of the third storage compartment 18 may be arranged transverse to the second outer edge 36, and may define a first lateral axis C1 of the bag 10. In some implementations, the upper edge 72 and the first lateral axis C1 are substantially perpendicular to the second outer edge 36.

An opening 74 of the third storage compartment 18 may be formed intermediate the upper edge 72 and the bottom edge 70, and may be substantially parallel to the upper edge 72. In alternate configurations, the opening 74 may be formed at an oblique angle with respect to the upper edge 72. As shown, the opening 74 of the third storage compartment 18 may include a closure 76 operable, or otherwise moveable, between an open position and a closed position, such that the third storage compartment 18 is selectively accessible. In the illustrated configuration, the closure 76 is a zipper. However, other types of closures for selectively enclosing the third storage compartment 18 will be appreciated. For example, the closure 76 may include buttons, clasps, hook and loop fasteners, double D-rings, magnets, adhesives, or the like. Alternatively, the third storage compartment 18 may be formed without the closure 76, such that the third storage compartment 18 is continuously accessible.

The main body 12 of the bag 10 may further include a rib 78 extending from the central longitudinal axis A to the first outer edge 34, and defining a second lateral axis C2 of the bag 10. As shown in FIG. 1, the rib 78 may be symmetrical to the upper edge 72 of the third storage compartment 18 with respect to the central longitudinal axis A, such that the first lateral axis C1 and the second lateral axis C2 are mirrored about the central longitudinal axis A and aligned in parallel (e.g., collinear) with each other when the bag 10 is folded about (e.g., along) the central longitudinal axis A to the first closed state.

Figure 4:
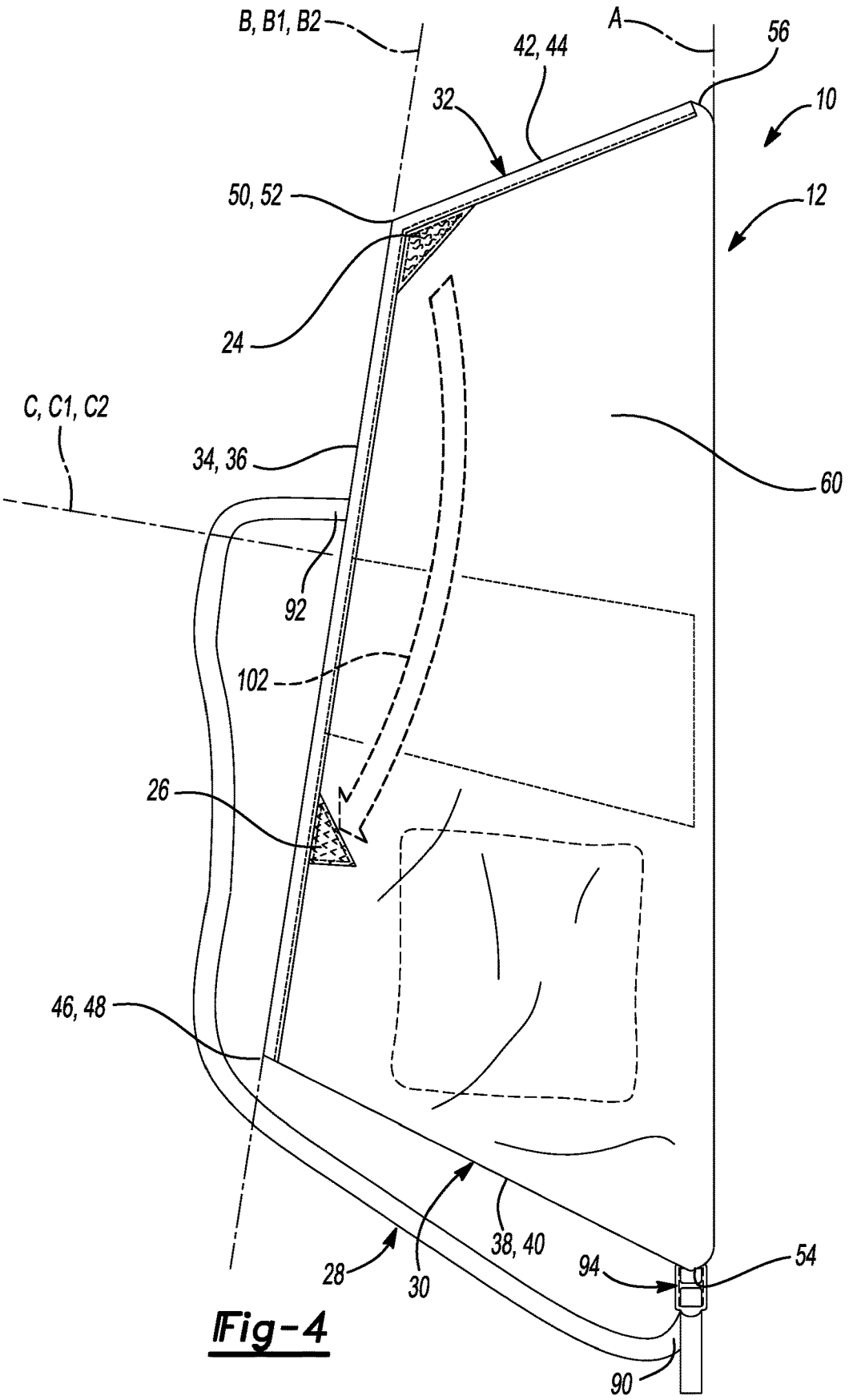
FIG. 4 is a front view of the bag of FIG. 1, showing the bag in a first closed state.
Figure 5:
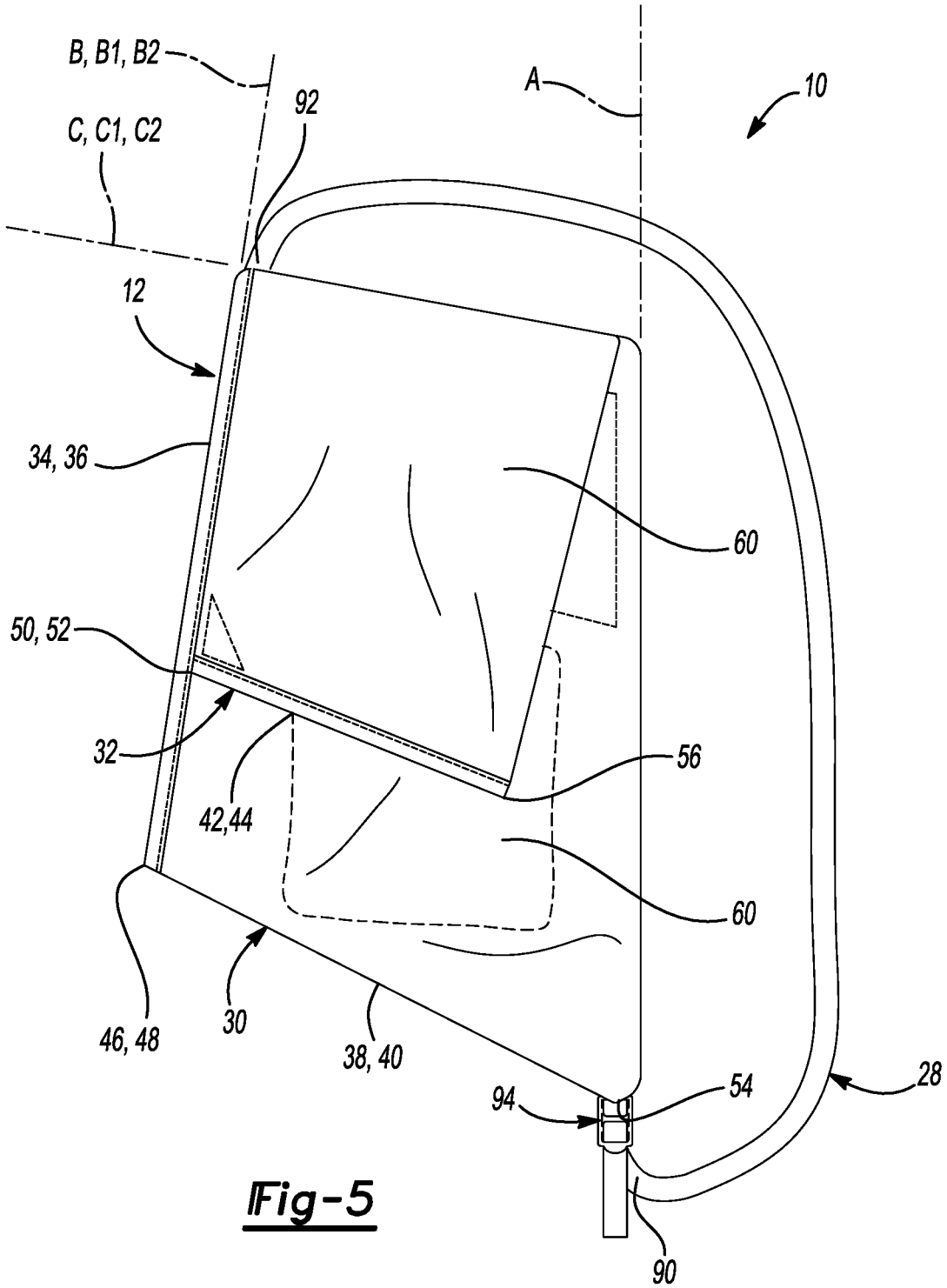
FIG. 5 is a front view of the bag of FIG. 1, showing the bag in a second closed state.

As shown in FIGS. 1-4, the bag 10 may include a plurality of the fasteners 20, 22, 24, 26 for securing the bag 10 in a first closed state, shown in FIG. 4, and in a second closed state, shown in FIG. 5. A first fastener 20 and a second fastener 22 may be formed on the front side 58 of the main body 12 on opposing sides of the central longitudinal axis A, such that the first fastener 20 is attachable to the second fastener 22 when the main body 12 is in the first closed state. A third fastener 24 and a fourth fastener 26 may be formed on the back side 60 of the main body 12, on the same side of the central longitudinal axis A, such that the third fastener 24 is attachable to the fourth fastener 26 when the main body 12 is in the second closed state.

With reference to FIGS. 1 and 3, the first fastener 20 may be disposed adjacent to the first outer edge 34 of the main body 12 and the second fastener 22 may be disposed adjacent to the second outer edge 36 of the main body 12.

In the configuration of FIGS. 1 and 3, the first fastener 20 is fragmented, and includes several segregated fastening members disposed along the first outer edge 34. For example, as shown in FIG. 1, the first fastener 20 includes a first fastening member 80 formed as a strip extending along the first outer edge 34 from the first corner 46 of the main body 12 to the upper edge 62 of the first storage compartment 14. The first fastener 20 further includes a second fastening member 82 formed as a triangular gusset in the third corner 50 of the main body 12. Alternatively or additionally, the first fastener 20 may include fastening members disposed on the front side 58 of the main body 12, intermediate the first outer edge 34 and the central longitudinal axis A. In other configurations the bag 10 may include fastening members disposed along the first outer edge 34, intermediate the upper edge 62 of the first storage compartment 14 and the third corner 50.

Referring again to the configuration shown in FIGS. 1 and 3, the second fastener 22 is fragmented and includes several fastening members arranged along the second outer edge 36. For example, the second fastener 22 may include a third fastening member 84 and a fourth fastening member 86 attachable to the first fastening member 80 when the main body 12 is in the first closed state. Particularly, the third fastening member 84 extends along the second outer edge 36 from the fourth corner 52 of the main body 12 to the upper edge 64 of the second storage compartment 16, while the fourth fastening member 86 extends along the second outer edge 36 from the bottom edge 70 of the third storage compartment 18 to the upper edge 72 of the third storage compartment 18. Accordingly, each of the third fastening member 84 and the fourth fastening member 86 may be arranged opposite the first fastening member 80 with respect to the central longitudinal axis A.

The second fastener 22 may further include a fifth fastening member 88 attachable to the second fastening member 82 when the main body 12 is in the first closed state. With reference to FIGS. 1 and 3, the fifth fastening member 88 is formed as a triangular gusset in the fourth corner 52 of the main body 12, opposite the second fastening member 82 with respect to the central longitudinal axis A.

With reference to FIGS. 2 and 4, the back side 60 of the main body 12 may include a third fastener 24 and a fourth fastener 26, attachable to each other when the main body 12 is in the second closed state. In the illustrated configuration, each of the third fastener 24 and the fourth fastener 26 are disposed adjacent to the second outer edge 36 of the main body 12. More specifically, the third fastener 24 is formed as a triangular gusset in the fourth corner 52 of the main body 12, while the fourth fastener 26 is arranged along the second outer edge 36, on an opposite side of the first lateral axis C1 from the third fastener 24. More specifically, the third fastener 24 and the fourth fastener 26 may be symmetrically disposed on opposite sides of the first lateral axis C1, such that the third fastener 24 is attachable to the fourth fastener 26 when the main body 12 is folded about (e.g., along) the first lateral axis C1 to the second closed state.

By forming each of the second fastening member 82, the fifth fastening member 88, and third fastener 24 as triangular gussets in the corners of the main body 12, additional strength is provided to the main body 12 of the bag 10, particularly at the corners of the main body 12.

In the illustrated configuration, each of the fasteners 20, 22, 24, 26 is formed of a hook-and-loop fastening material. However, in alternative configurations, other types of fasteners may be used, such as buttons, hooks, clasps, adhesives, magnets, zippers, or the like.

The strap 28 of the bag 10 may include a first end 90 attached to the first end 30 of the bag 10 and a second end 92 attached to one of the first outer edge 34 or the second outer edge 36. As shown in FIG. 2, the first end 90 of the strap 28 is selectively attached to the fifth corner 54 of the bag 10 by a fastener 94. The fastener 94 may further provide for adjustment of a length of the strap 28. In the illustrated configuration, the fastener 94 is a single-adjust, side-release buckle having a first portion 96 fixedly attached to the fifth corner 54 of the main body 12, and a second portion 98 adjustably attached to the first end 90 of the strap 28. In alternate configurations, the fastener 94 may include buttons, hook-and-loop fasteners, magnets, hooks, clasps, adhesives, b-rings, or the like.

With reference to FIG. 2, the second end 92 of the strap 28 may be attached to the back side 60 of the main body 12, and may be disposed along the second lateral axis C2 adjacent to the first outer edge 34. As shown, the second end 92 is fixedly attached to the main body 12 by stitching. However, in alternate configurations, the second end 92 may be fixedly attached by adhesive bonding, melding, or the like, or may be selectively attached using any one or more of the fastener types described above with respect to the first end 90 of the strap 28.

In one configuration, the strap 28 is formed of a synthetic fabric material, such as nylon or polypropylene. In alternate configurations, the strap 28 may be formed of natural materials, such as a cloth or leather.

Referring to FIGS. 3-5, one example of a use of the bag 10 is provided. As shown in FIG. 3, the bag 10 may initially be provided in an unfolded, open state, such that the first outer edge 34 of the bag 10 is spaced apart from the second outer edge 36 of the bag 10. Similarly, the first storage compartment 14 may be spaced apart from the second storage compartment 16, such that the openings 66, 68, 74 of each of the first storage compartment 14, the second storage compartment 16, and the third storage compartment 18, respectively, are easily accessible. Accordingly, the first storage compartment 14 may be provided with a first item, such as an article of footwear, and the second storage compartment 16 may be provided with a second item, such as a piece of apparel, as shown in FIG. 3.

As indicated by the dashed arrows 100 shown in FIG. 3, in a first step, the bag 10 is folded about (e.g., along) the central longitudinal axis A from the open state to the first closed state to bring a first portion of the front side 58 of the main body 12 in contact with a second portion of the front side 58 of the main body 12. For example, in the first closed state, the first storage compartment 14 may oppose, and be in contact with, the second storage compartment 16 and the third storage compartment 18. Further, as shown in FIG. 4, in the first closed state the second longitudinal axis B2 of the second outer edge 36 may be aligned with (e.g., parallel to) the first longitudinal axis B1 of the first outer edge 34 to define a common longitudinal axis B. Likewise, the first lateral axis C1 may be aligned with (e.g., parallel to) the second lateral axis C2 to define a common lateral axis C.

With reference to FIG. 4, from the first closed state, the main body 12 of the bag 10 is foldable into the second closed state. Particularly, the third fastener 24 of the bag 10 is attachable to the fourth fastener 26 by folding the bag 10 about (e.g., along) the common lateral axis C. The bag 10 is transitioned from the first closed state to the second closed state by folding the second end 32 of the bag 10 about the common lateral axis C, as indicated by dashed arrow 102, thereby bringing the third fastener 24 into contact with the fourth fastener 26. In the second closed state, the third fastener 24 is selectively attached to the fourth fastener 26 to maintain the main body 12 in the second closed state, as shown in FIG. 5.

Referring again to FIG. 5, in the second closed state the common lateral axis C may define a top edge of the bag 10. The second end 92 of the strap 28 may be attached to the top edge of the bag 10 in the second closed state. For example, in the second closed state, the second end 92 of the strap 28 may be attached to an upper corner of the top edge of the bag 10. Accordingly, the bag 10 can be conveniently carried by the strap 28, such that the strap 28 supports the bag 10 from the top portion defined by the common lateral axis C and a bottom portion defined by the fifth corner 54.

The following Clauses provide an exemplary configuration for a method of forming a foldable bag described above.

Clause 1: A bag comprising: a main body including a central longitudinal axis, a first outer edge having a first longitudinal axis that is convergent with the central longitudinal axis, and a second outer edge disposed on an opposite side of the central longitudinal axis than the first outer edge and having a second longitudinal axis that is convergent with the central longitudinal axis, the main body operable between an open state having the first outer edge separated from the second outer edge and a first closed state having the first outer edge aligned with and attached to the second outer edge; and a first storage compartment attached to a first side of the main body.

Clause 2: The bag of Clause 1, wherein the main body is symmetric about the central longitudinal axis.

Clause 3: The bag of Clause 1, wherein the first longitudinal axis is convergent with the second longitudinal axis when the main body is in the open state.

Clause 4: The bag of Clause 3, wherein the first longitudinal axis is parallel to the second longitudinal axis when the main body is in the first closed state.

Clause 5: The bag of Clause 1, wherein the first longitudinal axis is parallel to the second longitudinal axis when the main body is in the first closed state.

Clause 6: The bag of Clause 1, further comprising a second storage compartment attached to the first side of the main body.

Clause 7: The bag of Clause 6, wherein the first storage compartment is spaced apart from the second storage compartment when the main body is in the open state.

Clause 8: The bag of Clause 7, wherein the first storage compartment opposes and is in contact with the second storage compartment when the main body is in the first closed state.

Clause 9: The bag of Clause 1, further comprising a first fastener associated with the first outer edge and a second fastener associated with the second outer edge, the first fastener operable to be attached to the second fastener when the main body is in the first closed state.

Clause 10: The bag of Clause 1, wherein the main body is operable to be folded into a second closed state when in the first closed state.

Clause 11: The bag of Clause 10, wherein the main body includes a second side disposed on an opposite side of the main body than the first side.

Clause 12: The bag of Clause 11, wherein a first portion of the second side is in contact with a second portion of the second side when the main body is folded into the second closed state.

Clause 13: The bag of Clause 12, further comprising a first fastener attached to the first portion and a second fastener attached to the second portion, the first fastener selectively attached to the second fastener to maintain the main body in the second closed state.

Clause 14: The bag of Clause 12, wherein the main body is folded about an axis extending transverse to the second longitudinal axis when moved from the first closed state to the second closed state.

Clause 15: The bag of Clause 10, wherein the main body is folded about an axis extending transverse to the second longitudinal axis when moved from the first closed state to the second closed state.

Clause 16: A bag comprising: a main body including a central longitudinal axis, a first side, a second side disposed on an opposite side of the main body than the first side, and operable between an open state, a first closed state having a first portion of the first side in contact with a second portion of the first side, and a second closed state, the main body being folded about a lateral axis crossing the central longitudinal axis when moved from the first closed state to the second closed state to bring a first portion of the second side in contact with a second portion of the second side; and a first storage compartment attached to the first side of the main body.

Clause 17: The bag of Clause 16, wherein the main body is symmetric about the central longitudinal axis.

Clause 18: The bag of Clause 16, wherein the first outer edge includes a first longitudinal axis that is convergent with a second longitudinal axis of the second outer edge when the main body is in the open state.

Clause 19: The bag of Clause 18 wherein the first longitudinal axis is parallel to the second longitudinal axis when the main body is in the first closed state.

Clause 20: The bag of Clause 16, wherein the first outer edge includes a first longitudinal axis that is parallel to a second longitudinal axis of the second outer edge when the main body is in the first closed state.

Clause 21: The bag of Clause 16, further comprising a second storage compartment attached to the first side of the main body.

Clause 22: The bag of Clause 21, wherein the first storage compartment is spaced apart from the second storage compartment when the main body is in the open state.

Clause 23: The bag of Clause 22, wherein the first storage compartment opposes and is in contact with the second storage compartment when the main body is in the first closed state.

Clause 24: The bag of Clause 16, further comprising a first fastener associated with the first outer edge and a second fastener associated with the second outer edge, the first fastener operable to be attached to the second fastener when the main body is in the first closed state.

Clause 25: The bag of Clause 16, wherein the main body includes a second side disposed on an opposite side of the main body than the first side.

Clause 26: The bag of Clause 25, wherein a first portion of the second side is in contact with a second portion of the second side when the main body is moved into the second closed state.

Clause 27: The bag of Clause 26, further comprising a first fastener attached to the first portion and a second fastener attached to the second portion, the first fastener selectively attached to the second fastener to maintain the main body in the second closed state.

Clause 28: The bag of Clause 16, wherein the lateral axis is substantially perpendicular to the first edge.

Clause 29: The bag of Clause 28, wherein the lateral axis is substantially perpendicular to the second edge.

Clause 30: The bag of Clause 16, wherein the lateral axis is substantially perpendicular to the second edge.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A bag comprising:

a main body including a first end, a second end disposed at an opposite end of the main body than the first end, a central longitudinal axis extending between the first end and the second end, a first outer edge having a first longitudinal axis that is convergent with the central longitudinal axis, and a second outer edge disposed on an opposite side of the central longitudinal axis than the first outer edge and having a second longitudinal axis that is convergent with the central longitudinal axis, the first end including a third outer edge intersecting the first outer edge at a first junction and a fourth outer edge intersecting the second outer edge at a second junction, the third outer edge and the fourth outer edge angled relative to one another to connect at a first point, the second end including a fifth outer edge intersecting the first outer edge at a third junction and a sixth outer edge intersecting the second outer edge at a fourth junction, the fifth outer edge and the sixth outer edge angled relative to one another to connect at a second point, the main body operable between an open state having the first outer edge separated from the second outer edge and a first closed state having the first outer edge aligned with and attached to the second outer edge, and operable to be folded along a folding line into a second closed state when in the first closed state;

a first storage compartment attached to a first side of the main body; and a strap including a first end attached to the second end of the main body at the central longitudinal axis and a second end attached to the first outer edge of the main body, the second end adjacent to the folding line when the main body is in the second closed state.

2. The bag of claim 1, wherein the main body is symmetric about the central longitudinal axis.

3. The bag of claim 1, wherein the first longitudinal axis is convergent with the second longitudinal axis when the main body is in the open state.

4. The bag of claim 3, wherein the first longitudinal axis is parallel to the second longitudinal axis when the main body is in the first closed state.

5. The bag of claim 1, wherein the first longitudinal axis is parallel to the second longitudinal axis when the main body is in the first closed state.

6. The bag of claim 1, further comprising a second storage compartment attached to the first side of the main body, the first storage compartment being spaced apart from the second storage compartment when the main body is in the open state and opposing and in contact with the second storage compartment when the main body is in the first closed state.

7. The bag of claim 1, further comprising a first fastener associated with the first outer edge and a second fastener associated with the second outer edge, the first fastener operable to be attached to the second fastener when the main body is in the first closed state.

8. The bag of claim 1, wherein the main body includes a second side disposed on an opposite side of the main body than the first side, a first portion of the second side being in contact with a second portion of the second side when the main body is folded into the second closed state.

9. The bag of claim 8, further comprising a first fastener attached to the first portion and a second fastener attached to the second portion, the first fastener selectively attached to the second fastener to maintain the main body in the second closed state.

10. The bag of claim 8, wherein the main body is folded about an axis extending transverse to the second longitudinal axis when moved from the first closed state to the second closed state.

11. The bag of claim 1, wherein the main body is folded about an axis extending transverse to the second longitudinal axis when moved from the first closed state to the second closed state.

12. A bag comprising:

a main body including a first end, a second end disposed at an opposite end of the main body than the first end, a central longitudinal axis extending between the first end and the second end, a first side, and a second side disposed on an opposite side of the main body than the first side, the main body operable between an open state, a first closed state having a first portion of the first side in contact with a second portion of the first side, and a second closed state, the main body being folded about a lateral axis crossing the central longitudinal axis when moved from the first closed state to the second closed state to bring a first portion of the second side in contact with a second portion of the second side, the first end including a third side intersecting the first side at a first junction and a fourth side intersecting the second side at a second junction, the third side and the fourth side angled relative to one another to connect at a first point, the second end including a fifth side intersecting the first side at a third junction and a sixth side intersecting the second side at a fourth junction, the fifth side and the sixth side angled relative to one another to connect at a second point;

a first storage compartment attached to the first side of the main body; and a strap including a first end attached to the second point of the main body disposed on the central longitudinal axis and a second end attached to the first outer edge of the main body, the second end adjacent to the lateral axis crossing the central longitudinal axis when the main body is in the second closed state.

13. The bag of claim 12, wherein the main body is symmetric about the central longitudinal axis.

14. The bag of claim 12, wherein the first portion of the first side includes a first outer edge having a first longitudinal axis and the second portion of the first side includes a second outer edge having a second longitudinal axis, the first longitudinal axis convergent with the second longitudinal axis when the main body is in the open state.

15. The bag of claim 14, wherein the first longitudinal axis is parallel to the second longitudinal axis when the main body is in the first closed state.

16. The bag of claim 12, wherein the first portion includes a first longitudinal axis that is parallel to a second longitudinal axis of the second portion when the main body is in the first closed state.

17. The bag of claim 12, further comprising a second storage compartment attached to the first side of the main body, the first storage compartment being spaced apart from the second storage compartment when the main body is in the open state and opposing and in contact with the second storage compartment when the main body is in the first closed state.

18. The bag of claim 12, further comprising a first fastener associated with the first portion of the first side and a second fastener associated with the second portion of the first side, the first fastener operable to be attached to the second fastener when the main body is in the first closed state.

19. The bag of claim 12, further comprising a first fastener attached to the first portion and a second fastener attached to the second portion, the first fastener selectively attached to the second fastener to maintain the main body in the second closed state.

* * * * *